US011707660B1

(12) United States Patent
Smith

(10) Patent No.: US 11,707,660 B1
(45) Date of Patent: Jul. 25, 2023

(54) BALL ASSEMBLY

(71) Applicant: Country Innovation and Supply, LLC, Winder, GA (US)

(72) Inventor: Keaton Smith, Winder, GA (US)

( * ) Notice: Subject to any disclaimer, the term of this patent is extended or adjusted under 35 U.S.C. 154(b) by 0 days.

(21) Appl. No.: 17/676,975

(22) Filed: Feb. 22, 2022

(51) Int. Cl.

| | |
|---|---|
| ***A63B 69/36*** | (2006.01) |
| ***A63B 69/00*** | (2006.01) |
| *A63B 102/02* | (2015.01) |
| *A63B 102/18* | (2015.01) |

(52) U.S. Cl.
CPC ..... *A63B 69/0079* (2013.01); *A63B 69/0002* (2013.01); *A63B 69/3655* (2013.01); *A63B 2069/0008* (2013.01); *A63B 2102/02* (2015.10); *A63B 2102/18* (2015.10); *A63B 2102/182* (2015.10); *A63B 2209/00* (2013.01)

(58) Field of Classification Search
CPC ..... A63B 69/0079; A63B 69/0002; A63B 69/3655; A63B 2069/0008; A63B 2102/02; A63B 2102/18; A63B 2102/182; A63B 2209/00
USPC ..... 473/139, 142, 143, 145, 148, 415–417, 473/423, 424, 427, 429, 430, 481, 482
See application file for complete search history.

(56) References Cited

U.S. PATENT DOCUMENTS

| | | | | |
|---|---|---|---|---|
| 5,035,424 | A * | 7/1991 | Liao | A63B 69/0091 473/417 |
| 5,480,141 | A * | 1/1996 | Wood | A63B 69/0079 473/145 |
| 6,322,460 | B1 * | 11/2001 | Asci | A63B 69/0002 24/114.5 |
| 7,811,183 | B1 * | 10/2010 | Ohle | A63B 69/002 473/429 |
| 11,291,899 | B1 * | 4/2022 | Smith | A63B 69/3623 |
| 2010/0130313 | A1 * | 5/2010 | Bastian | A63B 15/00 473/457 |
| 2016/0158618 | A1 * | 6/2016 | Falzon | A63B 69/0079 473/430 |

* cited by examiner

*Primary Examiner* — Nini F Legesse

(57) ABSTRACT

A ball assembly for a swing trainer that withstands repeated hits with forces applied by professional athletes. The ball assembly comprises a ball, a wire rope, a ball stud swaged to one end of the wire rope and a connector sleeve swaged to the other end of the wire rope. A whole is drilled through the exact center of the ball and wire threaded therethrough. After the ball stud and connector sleeves are swaged to the ends of the wire rope, the ball stud is pressed into the hole in the ball. The wire rope may be coated to extend life.

7 Claims, 9 Drawing Sheets

BALL ASSEMBLY

The following application is an application for patent under 35 USC 111 (a).

FIELD

This disclosure relates to the field of an apparatus for baseball, softball, and golf swing training.

BACKGROUND

A baseball player exerts about 6000-8000 pounds (lbs) of force on a 5⅛ ounce (oz) baseball in order to hit the ball with enough force to reach a speed of 90 to 110 miles per hour (mph) in $1/1000^{th}$ of a second of bat and ball contact. During collision with a golf ball, the peak force applied by a golf club can be as high as 4000 pounds. Other swing training aids have attempted to create a swing trainer that can withstand these forces, but none have shown an appropriate design to withstand these forces over an extended period.

SUMMARY

This present disclosure solves the problem of a ball connection being unable to withstand high forces of impact repeated over a long period of time with a ball assembly apparatus capable of withstanding these forces over prolonged use, maintaining integrity of the device. Further, a method for creating a ball assembly apparatus capable of withstanding these forces is presented.

The ball assembly of the present disclosure comprises: a ball; a wire rope having a first and second end; a ball stud comprising an opening in a first end and cap on a second end; and a connector sleeve having an opening in a first end. A swaging connection joins a first end of the wire rope and the first end of the ball stud and a second end of the wire rope and the first end of the connector sleeve. The wire rope may be comprised of a hard metal. The ball stud and connector sleeve openings may be comprised of a soft metal. The ball stud and connector sleeve may be comprised of a soft metal. The ball stud and connector sleeve further comprise a hollow tunnel adjoining the openings with length being at least a quarter of the distance of the length of the ball stud or connector sleeve. The edges of the openings in the ball stud and connector sleeve may be rounded. The ball assembly may further comprise a coating on the wire rope. The coating may be a polyvinylchloride or a nylon coating. The ball of the ball assembly may be a baseball, softball, or golf ball, or other appropriate ball being a regulation ball sanctioned by appropriate authorities or a non-regulation ball.

The disclosure comprises a method of forming a ball assembly is presented, the method comprising: drilling a hole through the center of a ball; fitting a wire rope having a first end and a second end through the hole in the ball; swaging a ball stud to the first end of the wire rope; swaging a connector sleeve to the second end of the wire rope; and pressing the ball stud into the hole in the ball. The hole in the ball may have a bigger diameter than the wire rope and smaller diameter than the ball stud. The wire rope is swaged to the ball stud after inserting the first end of the wire rope into a hollow tunnel in one end of the ball stud, the hollow tunnel extending at least one quarter the length of the ball stud. The method may further comprise rounding edges of the openings of the ball stud and connector sleeve.

The disclosure comprises a method described above, wherein the wire rope is swaged to the connector sleeve after inserting the first second end of the wire rope into a hollow tunnel in one end of the connector sleeve, the hollow tunnel extending at least one quarter the length of the ball stud. A method described above wherein the wire rope is swaged to the connector sleeve after inserting the first second end of the wire rope into a hollow tunnel in one end of the connector sleeve, the hollow tunnel extending at least one third the length of the ball stud. The method may further comprise coating the wire rope.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Figure 2:
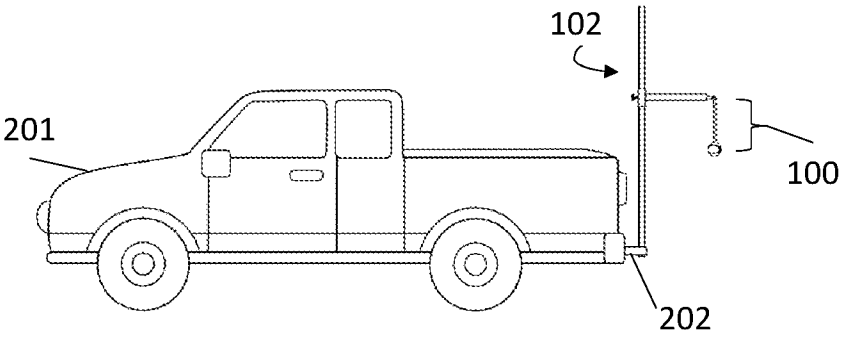
FIG. 2 illustrates a second example swing training device with attached ball assembly of the present disclosure.
Figure 1:
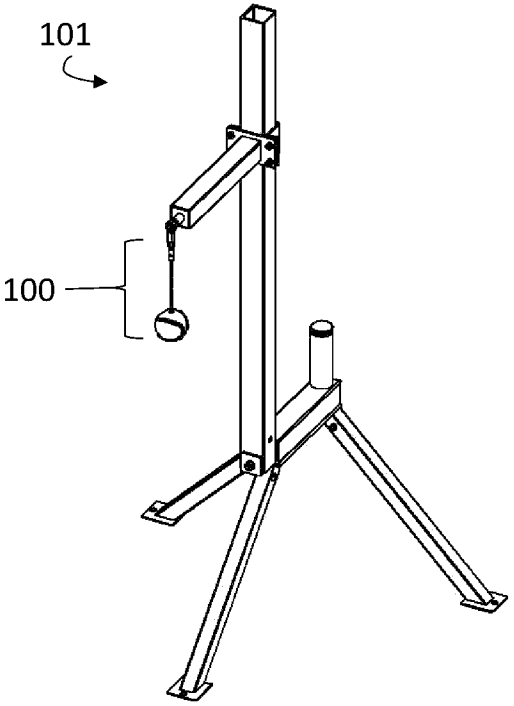
FIG. 1 illustrates an example swing training device with attached ball assembly of the present disclosure.

As illustrated in FIG. 1, the disclosed ball assembly 100 may be fitted to an example swing training stand 101. The swing training stand 101 serves the purpose of positioning the ball at the correct height and supporting the ball assembly 100. FIG. 2 illustrates an alternate system for supporting the ball assembly 100 with a second embodiment of a swing training device 102 attached to a vehicle 201 trailer hitch 202. The ball assembly may be supported or attached to a support system in various other ways with multiple design options to provide means for swing training for an athlete, being a person desiring athletic training.

Figure 3:
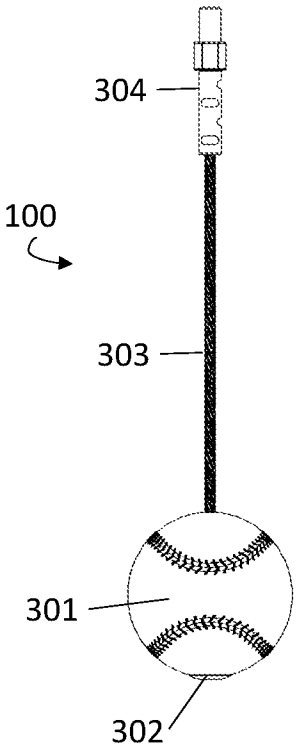
FIG. 3 is an illustration of one embodiment of the ball assembly of the present disclosure.

As illustrated in FIG. 3, the ball assembly 100 comprises a ball 301, ball stud 302, partially lying inside the ball in this view, wire rope 303, and connecting sleeve 304. The ball 301 may be a baseball, softball, golf ball, or tennis ball depending on swing training desired. The ball 301 comprises a regulation baseball, softball, golf ball, or tennis ball used by professional athletes and falls within the standards recognized by the associations of the given sport. This provides the athlete or user an experience that mimics real game play.

Figure 4:
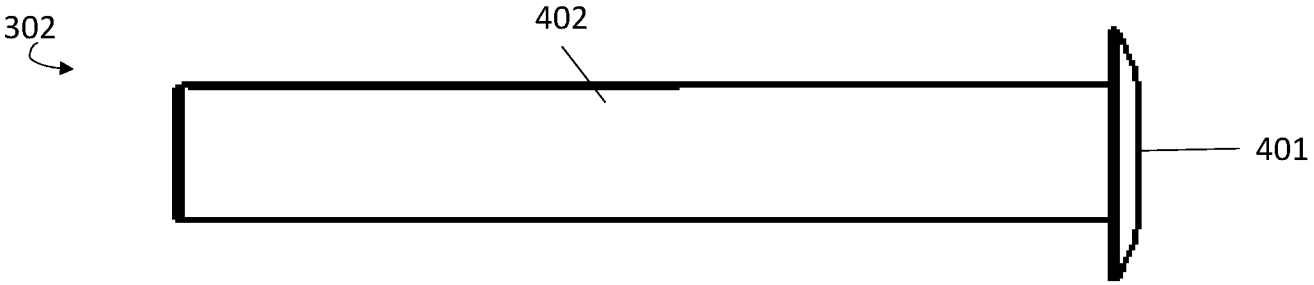
FIG. 4 is an illustration of the ball stud of the ball assembly.

As presented before, the challenge of many swing training devices is to create a swing trainer with attached ball that can withstand the forces of a professional athlete over months of practice. Attachment of a ball assembly with the following components in the following manner achieves this goal. As illustrated in FIG. 3, the ball 301 is held in place by a ball stud 302. The ball stud 302 is illustrated in further detail in FIGS. 4-5. As shown in FIG. 4, the ball stud 302 includes an end cap 401 and shank 402. The ball stud 302 is made of a soft metal. Soft metals may include brass, bronze, aluminum, strontium, lead, gold, silver, tin, zinc, cadmium, thallium, gallium, indium, barium, sodium, calcium, lithium, thorium, titanium, copper, and nickel, and combinations thereof, to name a few.

The ball stud 302, FIG. 4 length would be designed to the particular ball whether it be a baseball, softball, golf ball or tennis ball. Inasmuch, the ball stud 302 shaft 402, FIG. 4 may be at least 0.5 inches (in.), or at least 1.0 in., or 1.5 in. in length, or 2 in., or at least 2.5 in., at least 2.75 in. or at least 3 in., or at least 4 in., or at least 5 in. in length. Regulation baseballs are 2 and ⅞ in. to 3 in. in diameter and 9.0 to 9.25 inches in circumference with weight of 5 to 5.25 oz. A softball is generally larger than a baseball being about at least 3.5 in. to 3.82 in. in diameter, and eleven to sixteen inches in circumference. A golf ball is approximately 1.680 inches in diameter with "conforming" golf balls for United States Golf Association being not smaller than 1.680 inches in diameter with a weight of 1.62 ounces. A tennis ball may be approximately 2.575 inches in diameter with the definition of a regulation tennis ball by the International Tennis Federation being a diameter of at least 2.575 inches and not more than 2.700 inches. A tennis ball will weigh approximately 56.0-59.4 grams.

Figure 5:
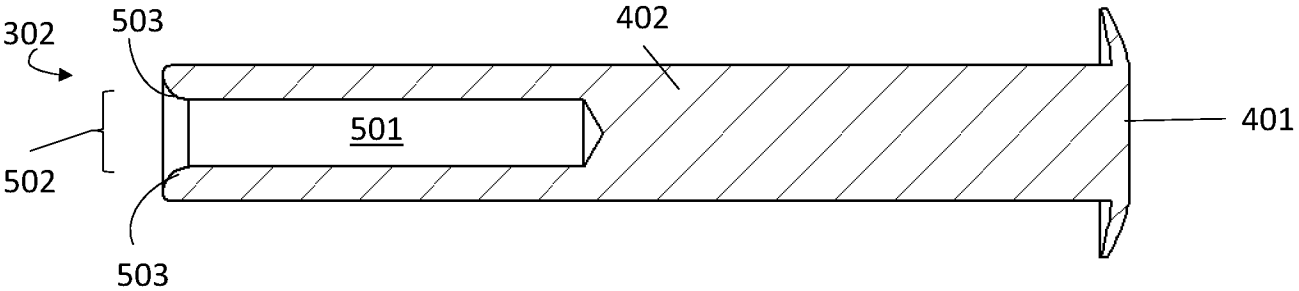
FIG. 5 is an illustration of a cross section of the ball stud.

As illustrated in the cross-section view of the ball stud 302 shown in FIG. 5, the ball stud 302 comprises a hollow tunnel 501 and opening 502 at the end opposite from the end cap 401. The outer edges of the end cap 401 may be curved or rounded to match the curvature of the ball. The edges 503 of the opening 502 are curved or rounded to reduce friction and wear on the wire rope once assembled. As will be described in further detail below the hollow tunnel 501 and opening 502 are designed to receive the wire rope 303 illustrated in FIG. 3. The hollow tunnel 501 may extend at least an eighth, or at least a quarter of the way into the shaft 402 of the ball stud 302, or at least a third of the way into the shaft 402 of the ball stud 302.

Figure 6:
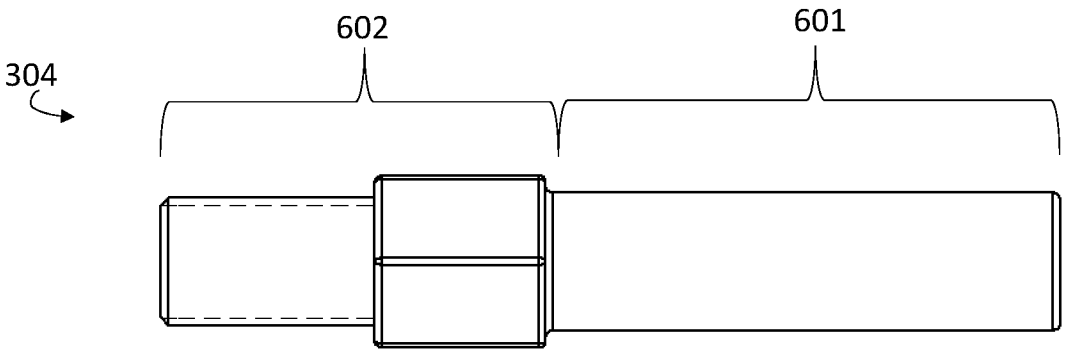
FIG. 6 is an illustration of the connecting sleeve of the ball assembly.
Figure 7:
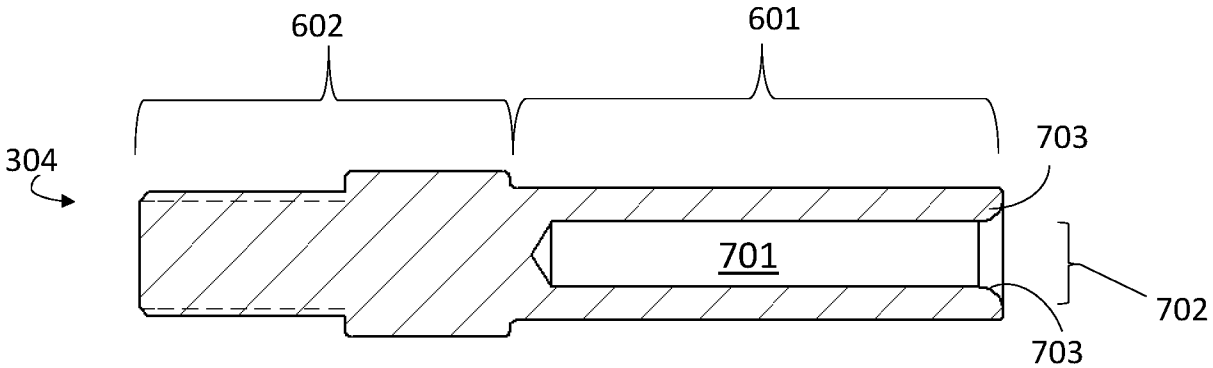
FIG. 7 is an illustration of a cross section of the connecting sleeve.

The connecting sleeve 304 is illustrated in further detail in FIGS. 6-7. The connecting sleeve 304 comprises a receiving shank 601 and designed end 602. The designed end 602 may comprise a number of fittings to be attached in various manners to another member or device whether via threaded connection or the like. As illustrated in the cross-section view FIG. 7 of the connecting sleeve 304, the receiving shank 601 comprises a hollow tube 701 and opening 702 at one end. As will be described in further detail below, the hollow tunnel 501 and opening 502 are designed to receive the wire rope 303 illustrated in FIG. 3. The edges 703 of the opening 702 are curved to reduce friction and wear on the wire rope once assembled. The hollow tunnel 701 may extend at least an eighth, or at least a quarter of the way into the shank 601 of the connector sleeve 304, or at least a third of the way into the shank 601 of the connector sleeve 304. The connecting sleeve 304 receiving shank 601 is made of a soft metal. Soft metals may include brass, bronze, aluminum, strontium, lead, gold, silver, tin, zinc, cadmium, thallium, gallium, indium, barium, sodium, calcium, lithium, thorium, copper, and nickel, and combinations thereof, to name a few. The designed end 602 may be made of a soft metal or other metals, soft or hard, and/or combinations thereof.

Figure 8:
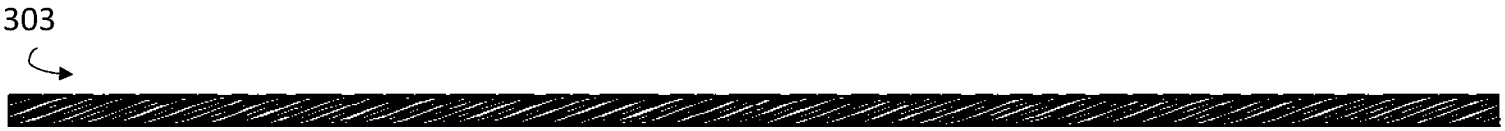
FIG. 8 is an illustration of the wire rope of the ball assembly.

The openings 502, 702 and hollow tunnels 501, 701 of the ball stud 302 and connecting sleeve 304 are designed to receive a wire rope 303 illustrated in FIG. 8. A wire rope 303 comprises several strands of metal wire twisted into a helix forming a composite rope in a pattern known as a laid rope. The wire rope may consist of multiple strands of such laid rope in a pattern known as cable laid. The term wire rope often refers to a wire rope with total diameter larger than 9.5 millimeters (mm) or ⅜ in or 0.375 in. The wire rope may be selected from one of the following including galvanized wire rope, stainless steel wire rope, bright steel wire rope, aircraft cable, and rotation resistant wire rope. The wire rope 303 may be coated or partially coated with a polyvinylchloride (PVC) or nylon to increase durability over time. Wire rope is often coated by the manufacturer and one method is jacketing application via pressurized extrusion. The wire rope 303 of the present disclosure may be at least 0.2 in., 0.375 in., or at least 0.5 in., or at least 0.6 in., or at least 0.7 in., or at least 0.8 in., or at least 0.9 in., or at least 1 in. or more in diameter.

Figure 9:
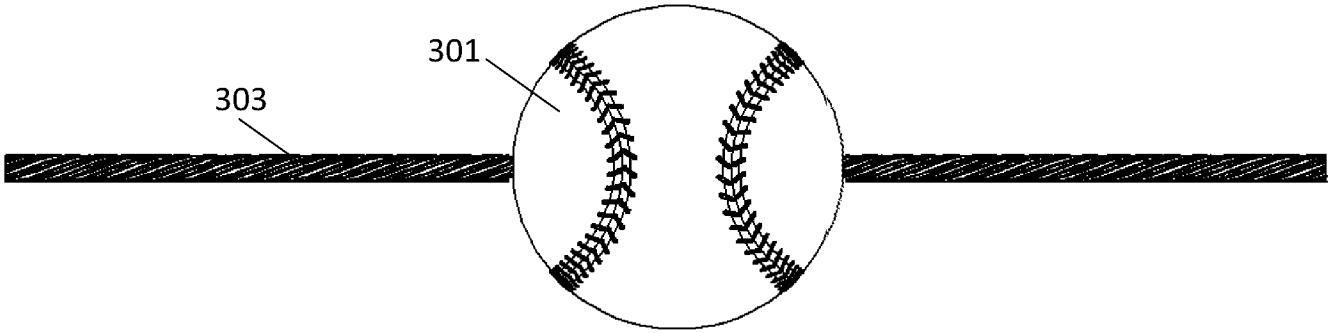
FIG. 9 is an illustration of a step in the method of creating the ball assembly.
Figure 10:
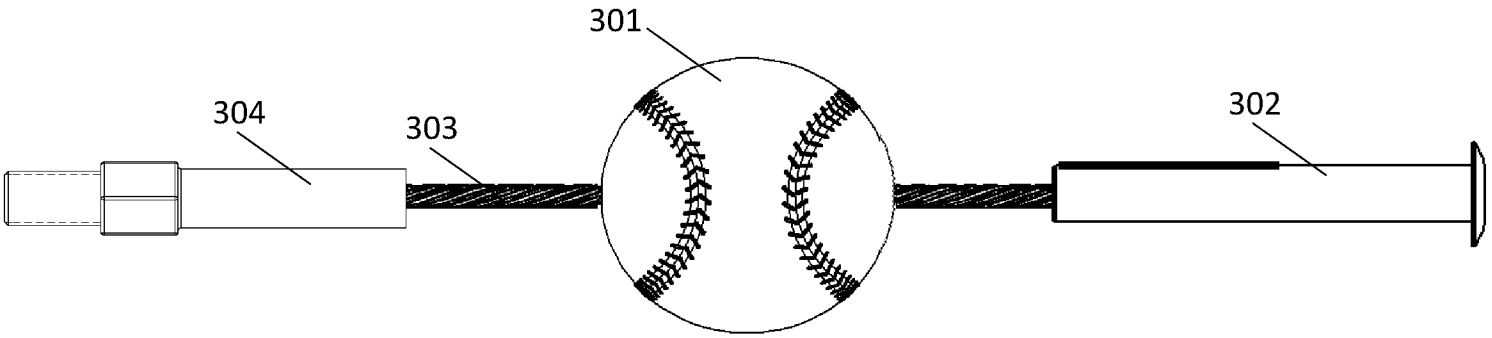
FIG. 10 is an illustration of a step in the method of creating the ball assembly.
Figure 11:
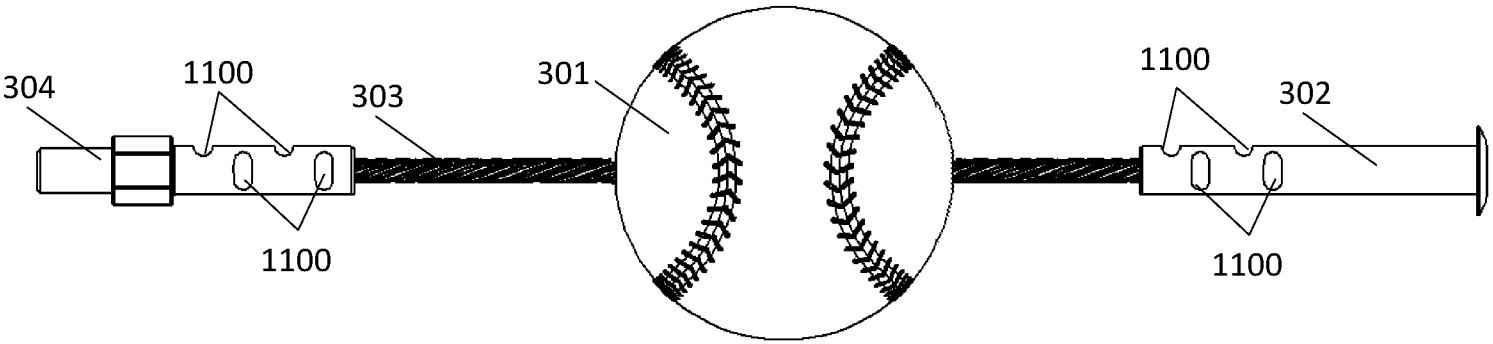
FIG. 11 is an illustration of a step in the method of creating the ball assembly.
Figure 12:
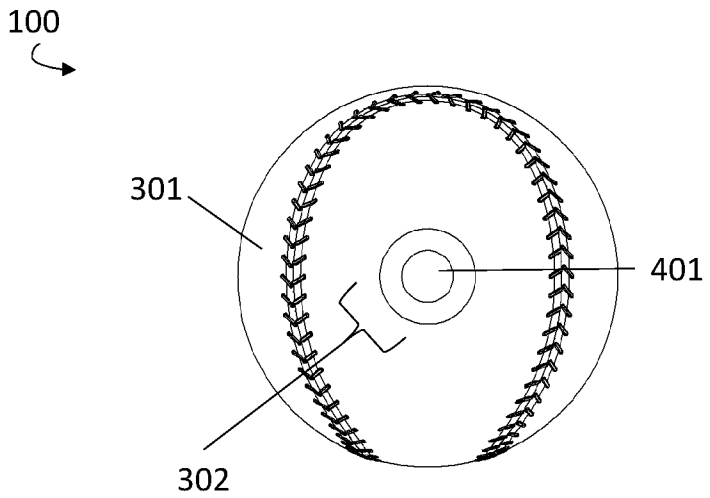
FIG. 12 is an illustration of an end view of the ball assembly.

For assembly of the ball assembly 100, FIG. 3, a hole is drilled through the ball 301, FIG. 3, through the exact center using a drill such as a drill press. The diameter of the hole would be designed to be just larger than the diameter of the wire rope 303 and slightly smaller than the diameter of the shaft 402, FIG. 4 of the ball stud 302. Following drilling, the wire rope 303 is thread through the hole in the ball 301 as illustrated in FIG. 9. As illustrated by FIG. 10, ends of the wire rope 303 are fitted into the openings and hollow tunnels (not shown) of the ball stud 302 and the connecting sleeve 304, one on each end of the wire rope 303 with the ball 301 fitted thereon. Following this step, as illustrated in FIG. 11, the ball stud 302 and the connecting sleeve 304 are swaged onto the wire rope 303. Swaging is a metal-forming technique in which the metal of one part is deformed to fit around another part by either pressing or hammering, or by forcing the material through a die. Swaging differs from forging in that the swaged metal is cold worked. Because the receiving ends or linings of the hollow tunnels and openings of the ball stud 302 and connecting sleeve 304 are made of soft metal and the metal wire is preferably a hard metal such as stainless steel, steel, or the like, the soft metal of the ball stud 302 and connecting sleeve 304 deforms with the swaging process into the wire rope 303 forming a tight, solid bond. Other hard or strong metals may include carbon steel, steel-iron-nickel alloy, tungsten, tungsten carbide, Inconel, chromium, iron, tungsten, iridium, osmium, chromium, and titanium. The divots 1100 formed by the swaging process in the swaged ends of the ball stud 302 and connecting sleeve 304 are illustrated in FIG. 11. Once the ball stud 302 and connecting sleeve 304 are bonded to the wire rope 303, a press, such as an Arbor press, may be used to force the ball stud 302 into the ball 301 through the exact same opening in the center of the ball made to feed the wire rope through the ball 301. FIG. 12 shows an illustration of the ball assembly 100 from the angle of the end or bottom of the assembly 100. The ball stud 302 end cap 401 sits flush with the ball 301 covering.

Figure 13:
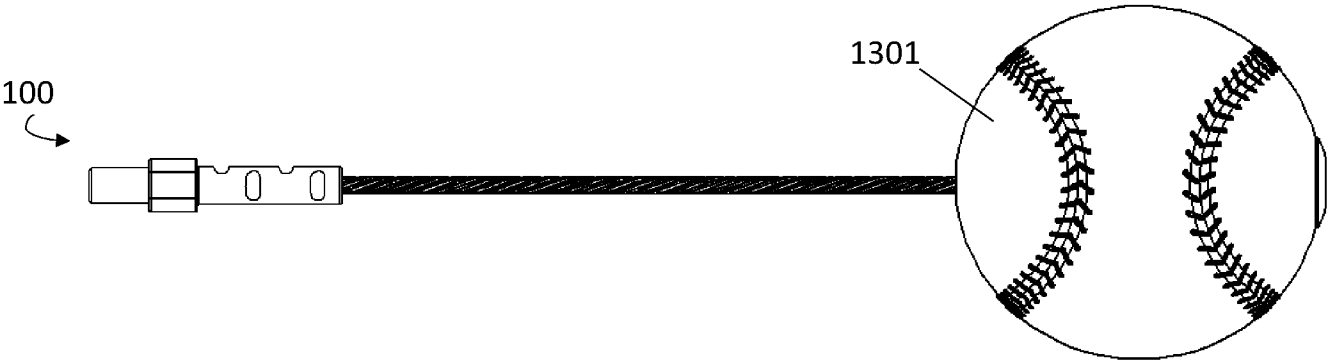
FIG. 13 is an illustration of a second embodiment of the ball assembly.
Figure 14:
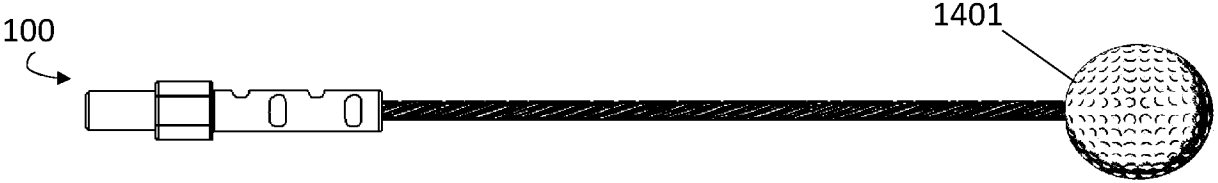
FIG. 14 is an illustration of a third embodiment of the ball assembly.
Figure 15:
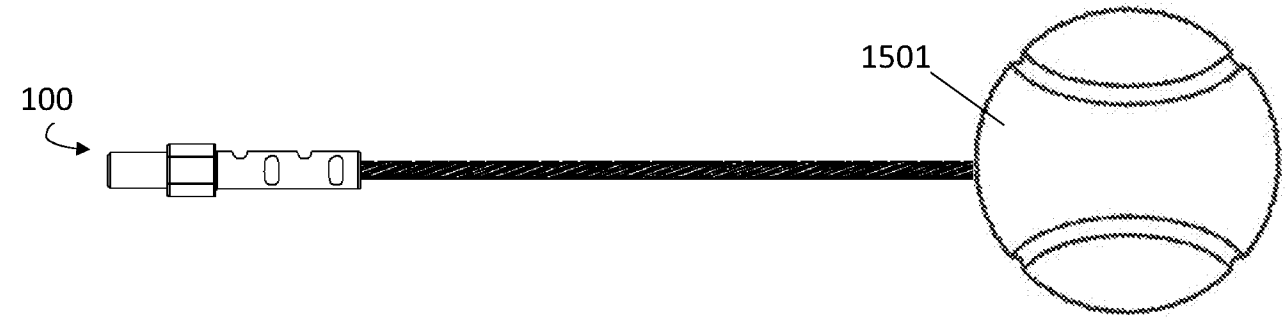
FIG. 15 is an illustration of a fourth embodiment of the ball assembly.
Figure 16:
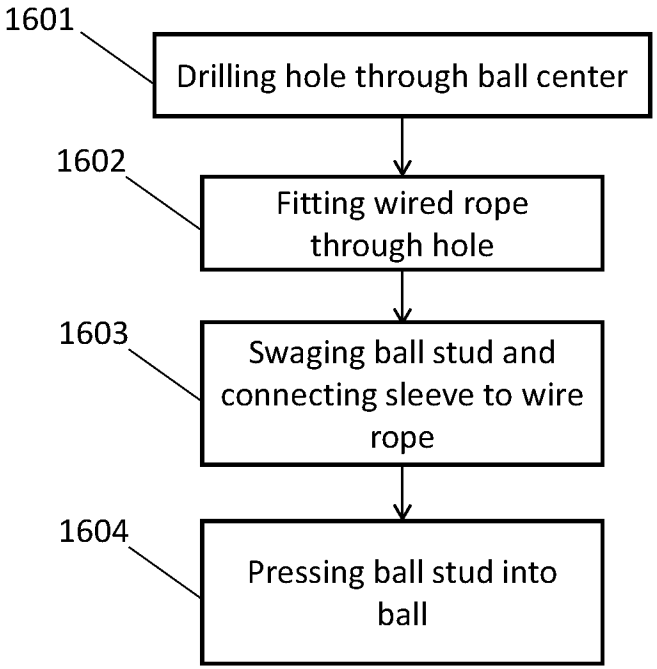
FIG. 16 is a block diagram illustrating a method for creating the ball assembly.

Other embodiments of a ball assembly 100 of the present disclosure are illustrated in FIGS. 13-15. As FIG. 3 and following figures may illustrate a baseball fitted on the ball assembly 100, FIGS. 13-15 illustrates a softball 1301, golf ball 1401, and tennis ball 1501 fitted on the ball assembly 100, respectively. The method of creating the ball assembly 100 is illustrated in the FIG. 16 block diagram. A hole is drilled through the exact center of the ball 1601. Following, a wire rope is fitted through the hole in the ball 1602. Next, the wire rope is fitted into the openings of the ball stud and connecting sleeve and ball stud and connecting sleeve are swaged to the wire rope 1603. Finally, the ball stud is pressed into the center hole of the ball 1604.

The device essentially as illustrated in FIG. 1 was used for baseball hitting practice by a professional athlete. The athlete hit the ball fifteen hundred times before the ball assembly failed. After this trial, the alteration of rounding the openings of the ball stud and connector sleeve as shown in FIGS. 5 and 7, 503 and 703 was performed. Longevity of the apparatus is expected to exceed two thousand hits by a professional athlete. If the ball is hit with less force, for instance by a smaller or younger athlete, the longevity is expected to exceed well beyond two thousand hits, perhaps even double to four thousand or greater number of hits.

Although the present invention has been described with reference to the disclosed embodiments and examples, numerous modifications and variations can be made and still the result will come within the scope of the invention. No limitation with respect to the specific embodiments disclosed herein is intended or should be inferred. Each apparatus and apparatus embodiment described herein has numerous equivalents.

What is claimed is:

1. A method of forming a ball assembly, the method comprising:

a) drilling a hole through the center of a ball;

b) fitting a wire rope having a first end and second end through the hole in the ball;

c) swaging a ball stud to the first end of the wire rope;

d) swaging a connector sleeve to the second end of the wire rope; and e) pressing the ball stud into the hole in the ball.

2. The method of claim 1, wherein the hole has a bigger diameter than the wire rope and smaller diameter than the ball stud.

3. The method of claim 1, wherein the wire rope is swaged to the ball stud after inserting the first end of the wire rope into a hollow tunnel in one end of the ball stud, the hollow tunnel extending at least one quarter the length of the ball stud.

4. The method of claim 1 further comprising rounding edges of the openings of the ball stud and connector sleeve.

5. The method of claim 1, wherein the wire rope is swaged to the connector sleeve after inserting the first second end of the wire rope into a hollow tunnel in one end of the connector sleeve, the hollow tunnel extending at least one quarter the length of the ball stud.

6. The method of claim 1, wherein the wire rope is swaged to the connector sleeve after inserting the first second end of the wire rope into a hollow tunnel in one end of the connector sleeve, the hollow tunnel extending at least one third the length of the ball stud.

7. The method of claim 1 further comprising coating the wire rope.

* * * * *